US011051097B2

(12) United States Patent
Soeta et al.

(10) Patent No.: US 11,051,097 B2
(45) Date of Patent: Jun. 29, 2021

(54) INSTALLATION STRUCTURE OF VIBRATOR

(71) Applicant: RION Co., Ltd., Tokyo (JP)

(72) Inventors: Akihiro Soeta, Tokyo (JP); Takashi Iwakura, Tokyo (JP)

(73) Assignee: RION Co., Ltd., Tokyo (JP)

( * ) Notice: Subject to any disclaimer, the term of this patent is extended or adjusted under 35 U.S.C. 154(b) by 0 days.

(21) Appl. No.: 17/003,443

(22) Filed: Aug. 26, 2020

(65) Prior Publication Data

US 2021/0067861 A1 Mar. 4, 2021

(30) Foreign Application Priority Data

Aug. 30, 2019 (JP) ..... JP2019-159004

(51) Int. Cl.
*H04R 1/10* (2006.01)
*H04R 5/033* (2006.01)

(52) U.S. Cl.
CPC ..... *H04R 1/1075* (2013.01); *H04R 1/10* (2013.01); *H04R 5/033* (2013.01); *H04R 2460/13* (2013.01)

(58) Field of Classification Search
CPC ..... H04R 1/1075; H04R 1/10; H04R 5/033; H04R 2430/13
See application file for complete search history.

(56) References Cited

U.S. PATENT DOCUMENTS

2013/0136279 A1* 5/2013 Brown ..... H04R 1/105 381/151
2015/0207392 A1 7/2015 Iwakura et al.
2021/0021698 A1* 1/2021 Hosoi ..... H04M 1/02

FOREIGN PATENT DOCUMENTS

JP 5653543 B1 1/2015

* cited by examiner

*Primary Examiner* — Andrew L Sniezek
(74) *Attorney, Agent, or Firm* — Rankin, Hill & Clark LLP

(57) ABSTRACT

An installation structure of a vibrator includes elastic members formed of an elastic material, the elastic members being arranged between a housing of a listening device, and the vibrator accommodating an electromechanical transducer for transducing an electric signal into mechanical vibration. The vibrator is installed on the listening device such that a lower surface of the vibrator is disposed at a position facing an ear cartilage in a state where the listening device is worn on an ear, and a first mechanical impedance of the elastic members between the vibrator and the housing is set smaller, at a frequency of 200 Hz to 1000 Hz, than twice a second mechanical impedance, with which the vibrator is loaded, of the ear cartilage.

6 Claims, 8 Drawing Sheets

INSTALLATION STRUCTURE OF VIBRATOR

CROSS-REFERENCE TO RELATED APPLICATION

This application is based on Japanese Patent Application No. 2019-159004 filed with the Japan Patent Office on Aug. 30, 2019, the entire content of which is hereby incorporated by reference.

BACKGROUND

1. Technical Field

One aspect of the present disclosure relates to an installation structure for installing a vibrator on a listening device.

2. Related Art

In recent years, as a vibrator having a structure in which an electromechanical transducer that transduces an electric signal into mechanical vibration is accommodated in a housing, a structure having a small size and a small mass has been proposed (for example, see Japanese Patent No. 5653543). Such a vibrator that has been made smaller and lighter is suitable for use in, for example, a device that can be worn on an ear. Examples of this type of device include a wireless earphone and a listening device such as a headset connectable to a mobile phone. Then, by wearing the above-mentioned listening device, on which the vibrator is installed, on a user's ear and disposing the vibrator to contact skin near ear cartilage, sound can be transmitted through a cartilage conduction course.

SUMMARY

An installation structure of a vibrator includes elastic members formed of an elastic material, the elastic members being arranged between a housing of a listening device, and the vibrator accommodating an electromechanical transducer for transducing an electric signal into mechanical vibration. The vibrator is installed on the listening device such that a lower surface of the vibrator is disposed at a position facing an ear cartilage in a state where the listening device is worn on an ear, and a first mechanical impedance of the elastic members between the vibrator and the housing is set smaller, at a frequency of 200 Hz to 1000 Hz, than twice a second mechanical impedance, with which the vibrator is loaded, of the ear cartilage.

DETAILED DESCRIPTION

Figure 1:
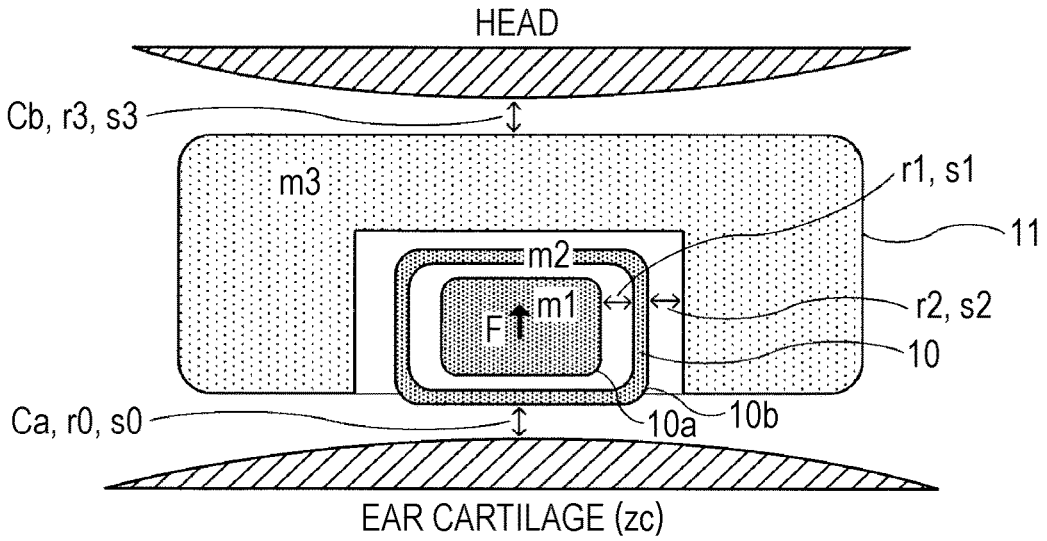
FIG. 1 illustrates a mechanical model according to one aspect of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

When size and weight of a vibrator are reduced as in recent years, influence of mass of a housing itself that accommodates the vibrator and a device (listening device or the like) on which the vibrator is installed is a problem. That is, if the mass of the vibrator is relatively larger than the mass of the device, the vibrator is less likely to be affected by the device. On the other hand, as the mass of the vibrator is relatively smaller due to weight reduction, the vibrator is more strongly affected by the mass of the device. Specifically, when the vibrator is simply joined to the device, a vibration force generated by the vibrator with a small mass is unintentionally used to vibrate the device, and for example, it is difficult to efficiently transmit vibration to be transmitted to ear cartilage. As a result, when the vibrator having a relatively small mass is driven in a state where it is installed on the device, there is a possibility that sound volume and vibration level may be lower than when the vibrator alone is driven.

An object of the present disclosure is to provide an installation structure of a vibrator that can transmit vibration to the ear cartilage with good transmission efficiency even when the vibrator with a small mass is installed on the listening device.

In order to address the above-described problem, an installation structure of a vibrator (this installation structure) according to an aspect of the present disclosure includes elastic members (22) formed of an elastic material, the elastic members being arranged between a housing (21) of a listening device, and the vibrator (20) accommodating an electromechanical transducer for transducing an electric signal into mechanical vibration. The vibrator is installed on the listening device such that a lower surface of the vibrator is disposed at a position facing an ear cartilage in a state where the listening device is worn on an ear, and a first mechanical impedance ($r2-js2/\omega$) of the elastic members between the vibrator and the housing is set smaller, at a frequency of 200 Hz to 1000 Hz, than twice a second mechanical impedance (zc), with which the vibrator is loaded, of the ear cartilage.

According to the present installation structure, the vibration is transmitted to the ear cartilage from the vibrator located at a position facing the ear cartilage in a state where the listening device is worn on the ear. At this time, since a first mechanical impedance of the elastic members between the housing of the listening device and the vibrator is sufficiently small, even when the mass of the vibrator is smaller than that of the listening device, energy of vibration is suppressed from being transmitted to the listening device. As a result, the vibration from the vibrator can be efficiently transmitted to the ear cartilage.

In the present installation structure, the elastic members may constitute a pair of elastic members (22, 23) including a second elastic member (23) that is disposed on an upper surface facing the lower surface of the vibrator and applies a pressing force to the vibrator, and, in this case, the pair of elastic members sandwiches and holds the vibrator. In this structure, due to the pressing force of the pair of elastic members, the vibrator slightly projects from the housing side of the listening device toward the ear cartilage. Therefore, the vibration of the vibrator is easily transmitted to the ear cartilage.

The present installation structure may further include a protrusion (24) provided on the lower surface of the vibrator and projecting toward the ear cartilage, and a recess (22*c*) provided on the elastic member and conforming to a shape of the protrusion, and the vibrator may be held by the elastic member with the protrusion being fitted in the recess. Thus, the vibrator can be stably held through the recess of the elastic member. In addition, the protrusion of the elastic member can be necessarily projected toward the ear cartilage. In this case, the recess of the elastic member can be formed such that its central axis is the same as a central axis of the columnar member as the protrusion and it has a diameter substantially the same as that of the columnar member.

The present installation structure may further include a flexible porous body (25) disposed on the upper surface facing the lower surface of the vibrator, and a holder (21*d*) provided in the housing and holding the porous body. In this case, the first mechanical impedance is a combined mechanical impedance of the elastic member and the porous body. As the flexible porous body, for example, sponge is used. Thus, the vibrator can be stably held by applying the pressing force to the porous body through the holder. In addition, the mass added to the vibrator can be suppressed The installation structure may further include an inner peripheral portion (22*f*) provided in the elastic member and covering a side surface of the vibrator, and the vibrator may be held by the elastic member while contacting the inner peripheral portion. Thus, the side surface of the vibrator is stably held by the inner peripheral portion of the elastic member. In addition, a total number of members can be reduced, and the structure can be simplified.

As described above, according to the present installation structure, the first mechanical impedance of the elastic members between the vibrator and the housing of the listening device is set smaller than twice the second mechanical impedance, with which the vibrator is loaded, of the ear cartilage. Therefore, even when the vibrator with a small mass is installed on the listening device, it is possible to increase the transmission efficiency of the vibration from the vibrator to the ear cartilage. The present installation structure is a structure in which the vibrator is not directly fixed to the housing of the listening device. Therefore, it is possible to suppress unnecessary vibration applied to the housing of the listening device.

Hereinafter, preferred embodiments of the present disclosure will be described with reference to the accompanying drawings. However, the embodiment described below is an example of a mode to which technology of the present disclosure is applied. The technology of the present disclosure is not limited by contents of the present embodiment. Hereinafter, a mode in which the technique of the present disclosure is applied to the vibrator that is installed on the listening device and transmits the vibration (sound) using cartilage conduction will be described.

FIG. 1 illustrates a mechanical model for studying characteristics required for the vibrator according to an embodiment of the present disclosure. FIG. 1 illustrates a vibrator 10 and a device 11 such as a listening device on which the vibrator 10 is installed. The vibrator 10 includes an internal vibrator body 10*a* and a vibrator case 10*b* that covers the vibrator body 10*a*. The ear cartilage is illustrated at the bottom of FIG. 1. The ear cartilage (skin is omitted) and one end of the vibrator 10 are in contact with each other at a contact portion Ca. A human head is illustrated at the top of FIG. 1. The head and one end of the device 11 are in contact with each other at a contact portion Cb.

In the mechanical model of FIG. 1, the vibrator body 10*a*, the vibrator case 10*b*, and the device 11 respectively have masses m1, m2, and m3. A force F is applied between the vibrator body 10*a* and the vibrator case 10*b*. The contact portions Ca and Cb, a space between the vibrator body 10*a* and the vibrator case 10*b*, and a space between the vibrator case 10*b* and the device 11 can be modeled using springs and dampers. Here, the contact portion Ca, the space between the vibrator body 10*a* and the vibrator case 10*b*, the space between the vibrator case 10*b* and the device 11, and the contact portion Cb are respectively supposed to have stiffnesses of springs s0, s1, s2, and s3 and have mechanical resistances r0, r1, r2, and r3 of the dampers.

Here, vibration displacements of the masses m1, m2, and m3 are respectively supposed to be x1, x2, and x3. Vibration displacement of the ear cartilage is supposed to be x0. The mechanical impedance of the ear cartilage, with which the vibrator 10 is loaded, is supposed to be zc. In this case, the following motion equations of formulas (1) to (4) are established for the mechanical model of FIG. 1. Here, ' (dash) represents a time derivative. For example, x1' represents velocity and x1" represents acceleration.

[Equation 1]

$$m_1x_1''=F-r_1(x_1'-x_2')-s_1(x_1-x_2) \tag{1}$$

$$m_2x_2''=-F-r_1(x_2'-x_1')-s_1(x_2-x_1)-r_2(x_2'-x_3')-s_2(x_2-x_3)-r_0(x_2'-x_0')-s_0(x_2-x_0) \tag{2}$$

$$m_3x_3''=-r_2(x_3'-x_2')-s_2(x_3-x_2)-r_3x_3'-s_3x_3 \tag{3}$$

$$z_cx_0'=-r_0(x_0'-x_2')-s_0(x_0-x_2) \tag{4}$$

Figure 2:
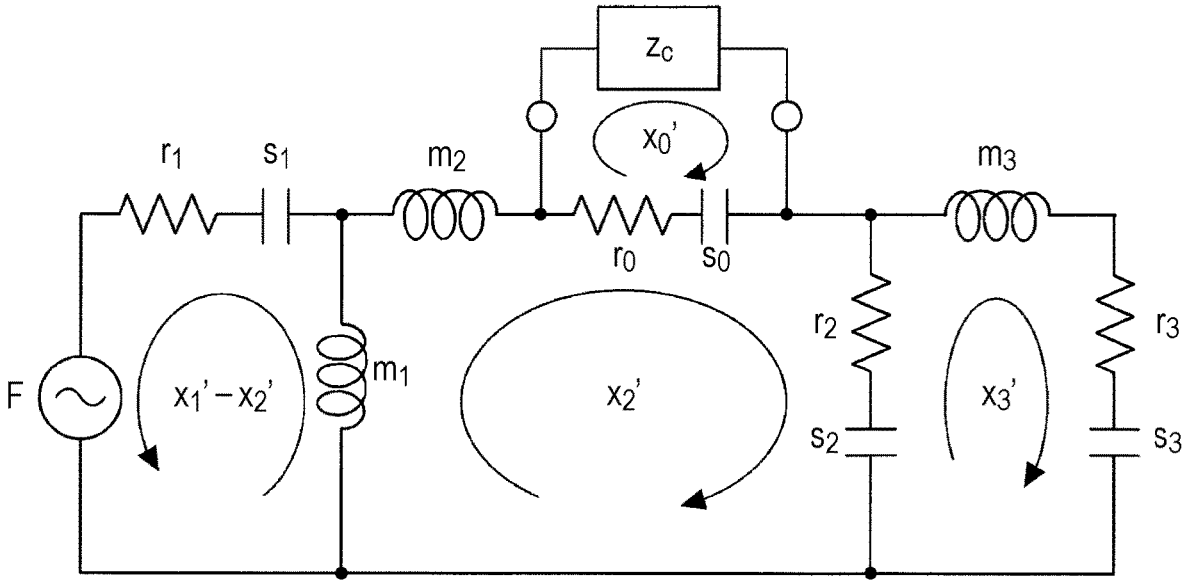
FIG. 2 illustrates an equivalent circuit corresponding to the mechanical model of FIG. 1.

An electrical circuit equivalent to the mechanical model can be derived from the above formulas (1) to (4). FIG. 2 illustrates an equivalent circuit corresponding to the mechanical model of FIG. 1. The velocities x0', x1', x2', and x3' in the formulas (1) to (4) respectively correspond to currents in the equivalent circuit. Comparing FIG. 1 and FIG. 2, the force F corresponds to an electromotive force of the equivalent circuit. The masses m1 to m3 correspond to inductances of the equivalent circuit. The stiffnesses s0 to s3 correspond to capacitances of the equivalent circuit (its value is a reciprocal of stiffness value). The mechanical resistances r0 to r3 correspond to resistances of the equivalent circuit. The mechanical impedance zc corresponds to an impedance of the equivalent circuit.

An object in the mechanical model of FIG. 1 is to apply as much vibration as possible to the ear cartilage. In this regard, since the vibrator 10 and the ear cartilage are in contact with each other at the contact portion Ca(r0, s0), the vibration applied to the ear cartilage is increased by increasing zc·x0' illustrated in FIG. 2 as much as possible. On the other hand, since the mass m3 of the device 11 is large, the mechanical impedance r2−js2/ω between the vibrator 10 and the device 11 is preferably set small in FIG. 2. If the mechanical impedance r2−js2/ω is large, the vibration x2' is extremely small. On the other hand, it is preferred that the mechanical impedance r0−js0/ω of the contact portion Ca(r0, s0) described above is set large.

Here, when the mechanical impedance of the ear cartilage was verified, it was confirmed that this impedance was approximately 5 (Ns/m) in a frequency range of 200 to 1000 Hz. An actual mechanical impedance value of the ear cartilage is supposed to change due to individual differences or the like. In the installation structure of the vibrator 10 of the present embodiment, the elastic member is placed between the vibrator 10 and the device 11 in order to achieve the above operational effects. The elastic member has a mechanical impedance (corresponding to r2−js2/ω in FIG. 2) smaller than the mechanical impedance of the ear cartilage corresponding to the mechanical impedance zc. This realizes a structure for efficiently vibrating the ear cartilage. A mechanical impedance value decreases in inverse proportion to a frequency. Therefore, even when the mechanical impedance value of stiffness of the elastic member is 10 Ns/m at a frequency of 100 Hz, the mechanical impedance of the elastic member only needs to be about 10 Ns/m or less.

Figure 3:
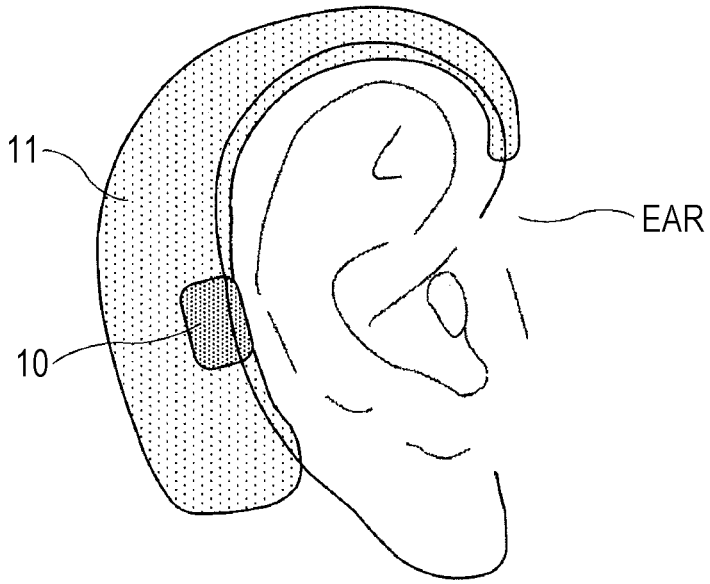
FIG. 3 schematically illustrates an example of a state where a device of FIG. 1 is worn on a human ear.

FIG. 3 schematically illustrates an example of a state where the device 11 of FIG. 1 is actually worn on a human ear. As illustrated in FIG. 3, the device 11 has a shape that fits a shape of the ear. The device 11 worn on the ear is held sandwiched between a pinna and the head. At this time, the lower surface of the vibrator 10 installed on the device 11 is disposed at a position facing the ear cartilage through the skin of the ear. Thus, when the vibrator 10 is driven, the vibration of the vibrator 10 is transmitted through the ear cartilage. A wearing state on the ear illustrated in FIG. 3 can be applied to the installation structures of the first to fourth embodiments, which will be specifically described below.

First Embodiment

Figure 4:
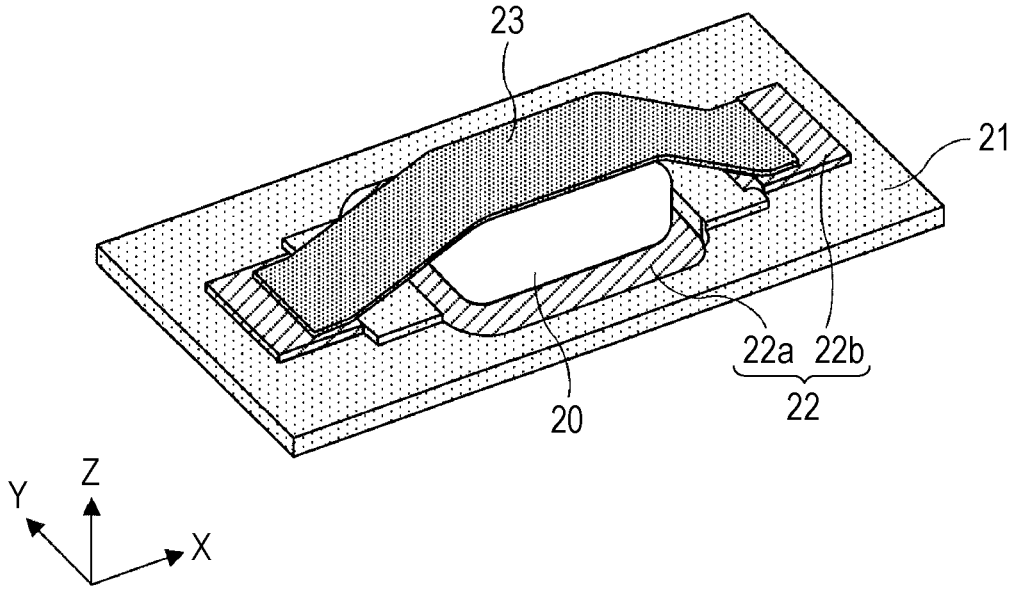
FIG. 4 is a perspective view of an installation structure of a first embodiment.
Figure 5:
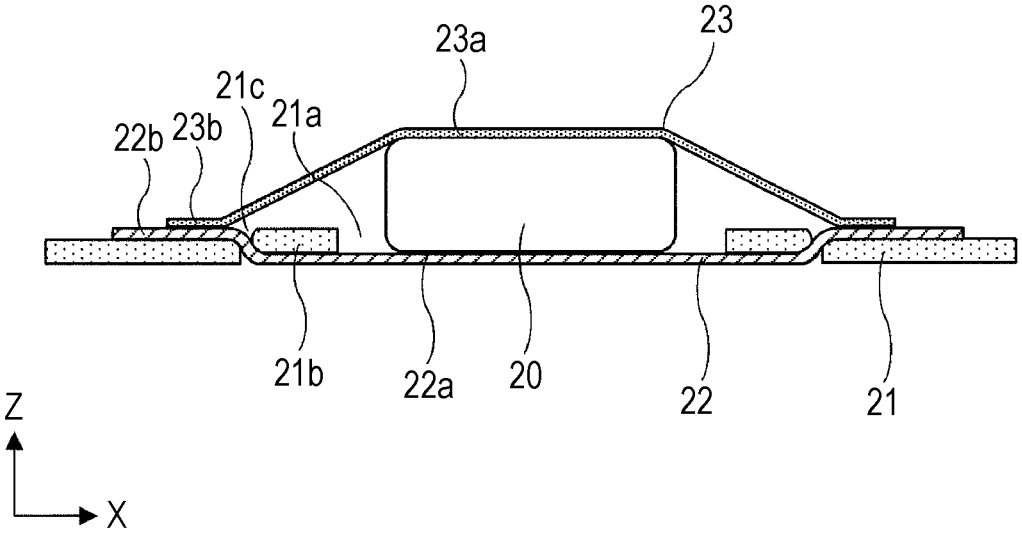
FIG. 5 is a partial cross-sectional view of the installation structure of the first embodiment.

Hereinafter, a first embodiment of the present disclosure will be described with reference to FIGS. 4 and 5. The installation structure according to the first embodiment includes a vibrator 20, a housing 21 of the listening device on which the vibrator 20 is installed, the elastic member 22 (first elastic member) disposed between the vibrator 20 and the housing 21, and the elastic member 23 (second elastic member) disposed on the vibrator 20. Regarding the installation structure of the first embodiment, FIG. 4 is a perspective view and FIG. 5 is a partial cross-sectional view. The partial cross-sectional view of FIG. 5 includes the side surface of the vibrator 20 of FIG. 4, and a cross-sectional structure of other members at a substantially central position in a Y direction of FIG. 4. In FIGS. 4 and 5, for convenience of explanation, an X direction, the Y direction, and a Z direction, which are orthogonal to each other, are indicated by arrows. Meanings of the X direction, the Y direction, and the Z direction are the same in FIG. 6 and subsequent drawings.

The vibrator 20 has a structure in which an electromechanical transducer that transduces an electric signal into the vibration is accommodated therein. The upper surface of the vibrator 20 in the Z direction is defined as an upper surface, and the lower surface in the Z direction is defined as a lower surface. The electromechanical transducer constituting a main body of the vibrator 20 includes, for example, a yoke, a coil, a magnet, an armature, an electric terminal, and the like (not shown). The housing 21 is, for example, the housing of the listening device such as an earphone on which the vibrator 20 is installed. An entire listening device including the housing 21 actually includes a structure that extends upward in the Z direction as illustrated in FIG. 3. In FIGS. 4 and 5, only a bottom surface portion of an entire housing of the listening device is illustrated as the housing 21, and the other structures of the housing are omitted.

The elastic member 22 is made of an elastic material having a predetermined elastic force and has a rectangular plate shape. A central portion 22*a* of the elastic member 22 at a center in the X direction is disposed on the lower surface of the vibrator 20. Both ends 22*b* of the elastic member 22 on both sides in the X direction are fixed to an upper surface of the housing 21. The central portion 22*a* of the elastic member 22 corresponds to the contact portion Ca in FIG. 1. This portion contacts the skin near the human ear cartilage. That is, the vibration of the vibrator 20 is transmitted to the ear cartilage through the elastic member 22. An opening 21*a* is formed in the housing 21. A pair of projecting portions 21*b* slightly projecting in the Z direction is formed on both sides of the housing 21 in the X direction. Further, the housing 21 is formed with a pair of slit portions 21*c* adjacent to both sides of the pair of projecting portions 21*b* in the X direction. The opening 21*a* is formed in a region surrounding the vibrator 20 when viewed from the Z direction. Then, the elastic member 22 has a structure in which the central portion 22*a* overlaps the region of the opening 21*a*, and a portion from the central portion 22*a* to the both ends 22*b* is bent upward through the pair of slit portions 21*c* described above.

The elastic member 23 is made of an elastic material having a predetermined elastic force, and has a rectangular plate shape. A central portion 23*a* of the elastic member 23 at the center in the X direction is disposed on the upper surface of the vibrator 20. Both ends 23*b* of the elastic member 23 on both sides in the X direction are fixed to upper surfaces of the both ends 22*b* of the elastic member 22 or the housing 21. Therefore, the elastic member 22 and the elastic member 23 (the pair of elastic members) have a structure in which the vibrator 20 is sandwiched from above and below in the Z direction. The elastic member 23 extends from the central portion 23*a* to the both ends 23*b*, and its cross-section is inclined. The elastic member 23 presses the vibrator 20 downward in the Z direction by its tension. Therefore, the pressing force of the elastic member 23 acts so that an lower side of the vibrator 20 and the central portion 22*a* of the elastic member 22 slightly project downward in the Z direction of the housing 21 (outside the listening device) (not illustrated in FIG. 5). Therefore, the vibration of the vibrator 20 is easily transmitted to the ear cartilage.

In the first embodiment, as described using the mechanical model and the equivalent circuit (FIGS. 1 and 2), it is characteristic that the combined mechanical impedance (hereinafter, referred to as "first mechanical impedance") of the elastic member 22 disposed between the vibrator 20 and the housing 21, and the elastic member 23 disposed on the upper surface of the vibrator 20 is set smaller, at a frequency of 200 Hz to 1000 Hz, than twice the mechanical impedance (hereinafter, referred to as "second mechanical impedance"), with which the vibrator 20 is loaded, of the ear cartilage. The first mechanical impedance depends on parameters such as size, thickness, and elastic modulus of the elastic members 22 and 23. Therefore, it is preferable to adjust the mechanical impedance value to an appropriate value by appropriately setting the parameters. Adjustment of the first mechanical impedance and its effect will be described in detail below.

There are various methods for fixing the both ends 22*b* of the elastic member 22 and the both ends 23*b* of the elastic member 23 to the housing 21. As this method, there can be employed, for example, a method such as adhesion or fusion, a method in which a pin provided on the housing 21 is passed through holes provided in the elastic members 22 and 23, or the combination of these methods. Note that it is preferred that a certain amount of tension is applied to the elastic member 23 when fixed to the housing 21. However, it is not desired to apply unnecessary tension to the elastic member 22.

Here, regarding the elastic member 22 and the elastic member 23, the above-described method for adjusting the first mechanical impedance will be described. First, in relation to the size of the elastic member 22, the larger an area (a length) and the thinner the thickness in the Z direction, the smaller the first mechanical impedance. Further, the larger the elastic modulus of the elastic member 22, the larger the first mechanical impedance. Therefore, in order to reduce the first mechanical impedance, the area (length) of the elastic member 22 may be increased, the thickness may be reduced, and the elastic modulus may be reduced. In an example of FIGS. 4 and 5, the thickness of the elastic member 22 is restricted by strength or the like. Therefore, in order to reduce the first mechanical impedance, it is preferable to secure a certain length in the X direction of the opening 21*a* overlapping the elastic member 22. The same applies to the elastic member 23. In the first embodiment, the combined mechanical impedance of the elastic member 22 and the elastic member 23 is the first mechanical impedance. Examples of the elastic material forming the elastic members 22 and 23 include low hardness rubber, thermoplastic elastomer, and gel, having a Shore A hardness of 40 or more and 50 or less.

As described above, by employing the installation structure of the first embodiment, even when the mass of the vibrator 20 is relatively smaller than the mass of the listening device, it is possible to obtain an effect of increasing the transmission efficiency of vibration from the vibrator 20 to the ear cartilage. That is, in the installation structure of the first embodiment, the first mechanical impedance obtained by combining the elastic member 22 disposed between the vibrator 20 and the housing 21 of the listening device, and the elastic member 23 disposed on the upper surface of the vibrator 20 is set smaller than twice the second mechanical impedance, with which the vibrator 20 is loaded, of the ear cartilage. Therefore, as described with reference to FIGS. 1 and 2, it is possible to suppress vibration energy transmitted to the listening device. As a result, the vibration energy transmitted to the ear cartilage can be sufficiently increased. The installation structure of the first embodiment is a structure in which the vibrator 20 is not directly fixed to the housing 21 of the listening device. Therefore, it is possible to obtain an effect of reducing unnecessary vibration applied to the housing 21 of the listening device. Further, the vibrator 20 can be brought into good contact with the skin near the ear cartilage. Furthermore, a waterproof effect can be obtained by the elastic member 22 and the housing 21 of the listening device. The above basic effects are common to the second to fourth embodiments described below in addition to the first embodiment.

Second Embodiment

Figure 6:
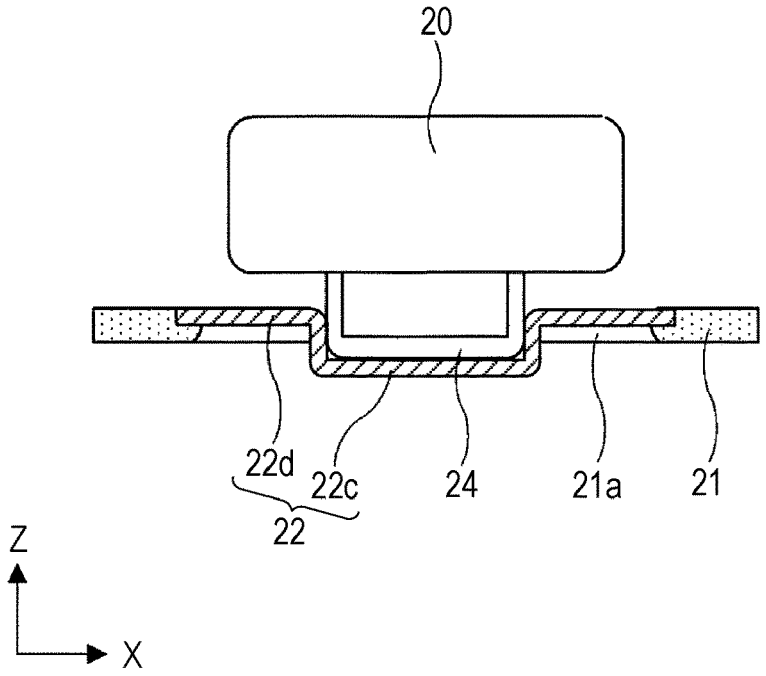
FIG. 6 is a partial cross-sectional view of the installation structure of a second embodiment.
Figure 7:
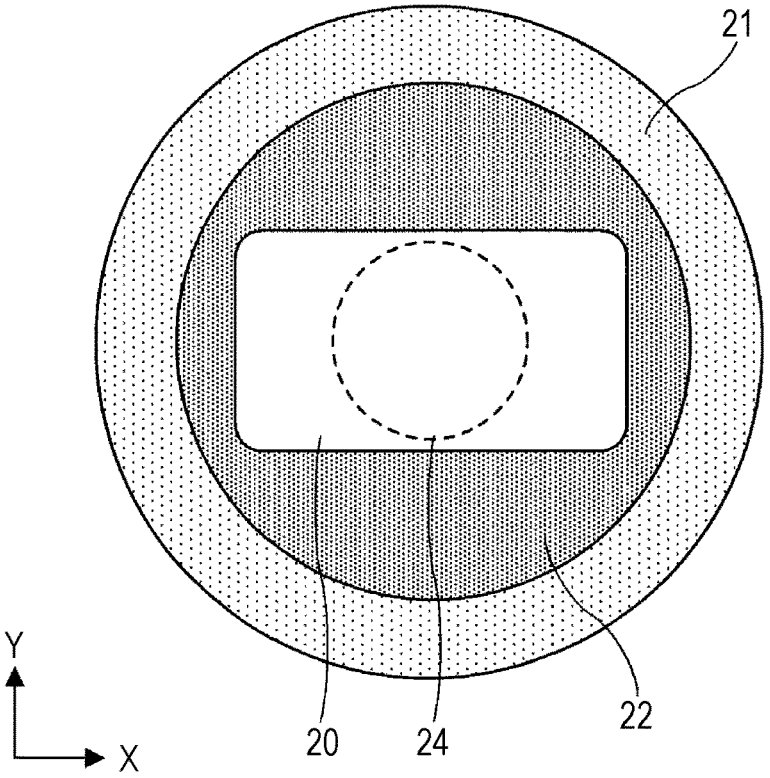
FIG. 7 is a top view of the installation structure of the second embodiment.

Hereinafter, the second embodiment of the present disclosure will be described with reference to FIGS. 6 and 7. The installation structure according to the second embodiment includes a columnar member 24 connected to the lower surface of the vibrator 20 in addition to the vibrator 20, the housing 21, and the elastic member 22. Regarding the installation structure of the second embodiment, FIG. 6 is a partial cross-sectional view like FIG. 5, and FIG. 7 is a top view seen from above in the Z direction. In the second embodiment, the structure of the vibrator 20 is the same as that of the first embodiment. The second embodiment is different from the first embodiment in that the structures of the housing 21 and the elastic member 22 are different from those of the first embodiment, and the columnar member 24 is provided without providing the elastic member 23. The columnar member 24 is an example of a protrusion projecting toward the ear cartilage. The columnar member 24 connected to the vibrator 20 may be formed separately from the vibrator 20 and joined to the vibrator 20. Alternatively, the columnar member 24 may be formed integrally with the vibrator 20.

As illustrated in FIG. 7, outlines of the housing 21 and the elastic member 22 are both circular when viewed in a plan view from the Z direction. The diameter of the elastic member 22 is smaller than that of the housing 21 concentric with the elastic member 22. The housing 21 is formed with a circular opening 21*a* (FIG. 6) in a plan view. The diameter of the upper portion of the opening 21*a* matches the diameter of the elastic member 22. The lower portion of the opening 21*a* has a diameter slightly smaller than that of the elastic member 22. As illustrated in FIG. 6, a cylindrical portion 22*c* is formed in a center of the elastic member 22. A donut-shaped outer peripheral portion 22*d* is formed around the cylindrical portion 22*c* of the elastic member 22. The cylindrical portion 22*c* is an example of a recess provided in the elastic member 22 and conforming to a shape of the columnar member 24 that is the protrusion. The cylindrical portion 22*c* is formed such that its central axis is the same as a central axis of the columnar member 24 and it has a diameter substantially the same as that of the columnar member 24. Therefore, in this structure, vicinity of an outer edge of the outer peripheral portion 22*d* of the elastic member 22 is held at a step of the opening 21*a* of the housing 21. Also in the second embodiment, as in the first embodiment, a method using adhesion or fusion, a method using a pin, or the combination of these methods is employed as a method for fixing the elastic member 22 to the housing 21.

On the other hand, in FIG. 7, the columnar member 24, which is indicated by a broken line overlapping the vibrator 20, is formed in a cylindrical shape having a diameter smaller than an entire diameter of the elastic member 22 concentric with the column member 24 in a plan view seen from the Z direction. An inside of the columnar member 24 is hollow for weight reduction. Then, an inner peripheral surface of the cylindrical portion 22*c* of the elastic member 22 has a shape fitting with the columnar member 24. That is, in this structure, the columnar member 24 is covered with the cylindrical portion 22*c* of the elastic member 22. The vibrator 20 is held by the elastic member 22 in a state where the cylindrical portion 22*c* is fitted onto the cylindrical member 24.

In the installation structure of the second embodiment, the columnar member 24 connected to the vibrator 20 contacts the skin near the ear cartilage through the cylindrical portion 22*c* of the elastic member 22. Therefore, compared to the first embodiment, the vibrator 20 can be positioned so that a narrower area faces the ear cartilage. Further, the vibrator 20 is not pressed by the elastic member 23 like the first embodiment, but the cylindrical member 24 can be held together with the vibrator 20 from its outer peripheral side by a side surface of the cylindrical portion 22*c* of the elastic member 22.

The second embodiment is also similar to the first embodiment in that the first mechanical impedance of the elastic member 22 is set smaller than twice the second mechanical impedance of the ear cartilage. However, the elastic member 22 of the second embodiment has a different structure from the elastic member 22 of the first embodiment. Therefore, in the elastic member 22 of the second embodiment, parameters such as area and thickness are required to be adjusted differently from those of the first embodiment. Note that, in the second embodiment, since the basic effect obtained by setting the first mechanical impedance smaller than twice the second mechanical impedance is the same as the first embodiment, its description will be omitted. Further, in the structure of the second embodiment, the columnar member 24 and the cylindrical portion 22*c* of the elastic member 22 project in a pinpoint manner toward the contact portion Ca (FIG. 1). Thus, the pressing force of the cylindrical portion 22*c* may cause pain on the skin of the ear. Therefore, in the second embodiment, a structural design is required in consideration of the force applied to the skin of the ear when the listening device is worn on the ear.

In the second embodiment, shapes of the columnar member 24 that is the protrusion and the cylindrical portion 22*c* of the elastic member 22 that is the recess are not respectively limited to a columnar shape and a cylindrical shape. That is, if the protrusion connected to the lower surface of the vibrator 20 and the recess of the elastic member 22 can be fitted with each other, the protrusion and the recess can be formed to have various cross-sectional shapes.

Figure 8:
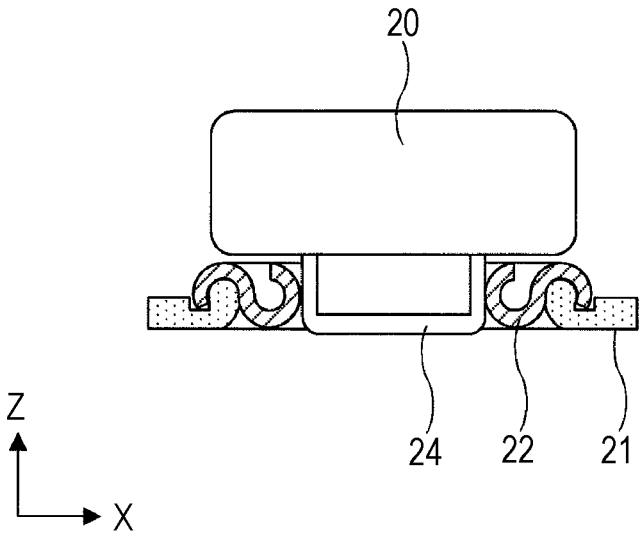
FIG. 8 is a partial cross-sectional view like FIG. 6 regarding a modification of the second embodiment.

Next, FIG. 8 illustrates a partial cross-sectional view like FIG. 6 regarding a modification of the second embodiment. In the present modification, a structure of the elastic member 22 in FIG. 6 is mainly changed. That is, as illustrated in FIG. 8, the elastic member 22 of the present modification has a substantially S-shaped cross-sectional shape. In this structure, a shape near the outer edge of the elastic member 22 and a shape near the opening 21*a* of the housing 21 match each other. At this portion, the elastic member 22 is held by the housing 21 directly below. In addition, vicinity of an inner edge of the elastic member 22 has a structure that surrounds and holds a side surface of the columnar member 24.

By employing the structure of the modification of FIG. 8, it is possible to increase a path length in a cross-sectional view of the elastic member 22 from the vibrator 20 to the housing 21 and to increase a substantial area of the elastic member 22. Thus, it is possible to realize a structure that is advantageous for reducing the first mechanical impedance without increasing an overall size of the elastic member 22. In this case, as compared with FIG. 6, when the same first mechanical impedance is set, the thickness of the elastic member 22 can be set larger, for example, as the path length in a cross-sectional view of the elastic member 22 is longer. Therefore, it is possible to realize a stronger structure.

Third Embodiment

Figure 9:
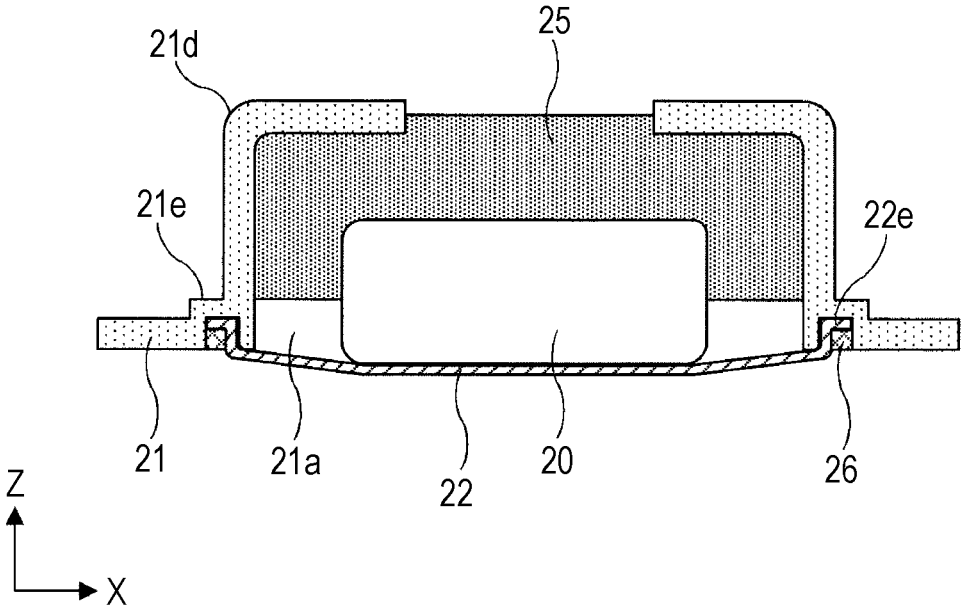
FIG. 9 is a partial cross-sectional view of the installation structure of a third embodiment.
Figure 10:
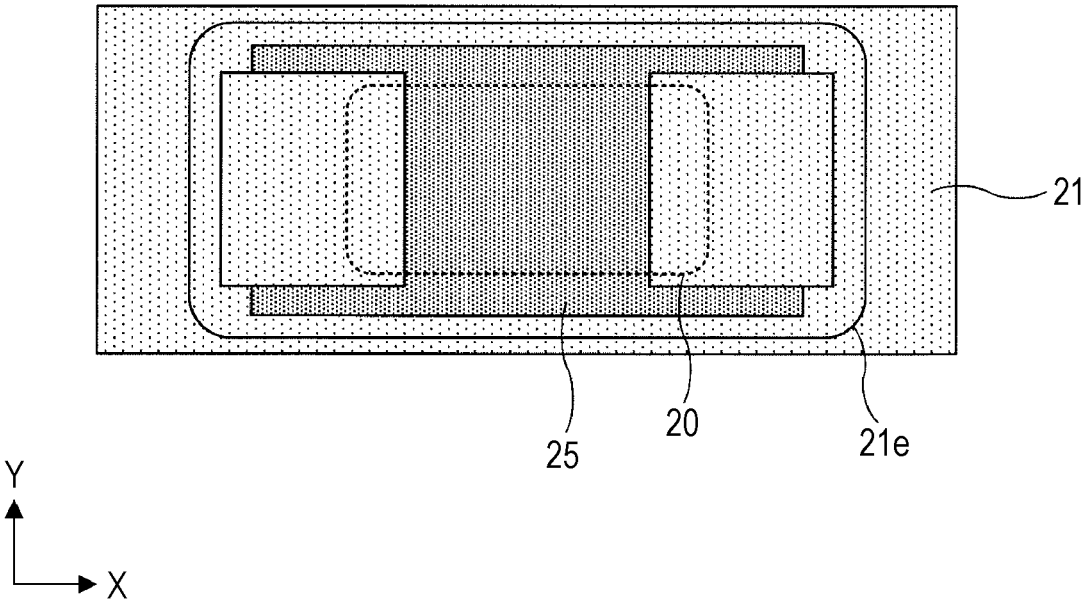
FIG. 10 is a top view of the installation structure of the third embodiment.

Hereinafter, a third embodiment of the present disclosure will be described with reference to FIGS. 9 and 10. The installation structure according to the third embodiment includes a holder 21*d* and a sponge 25 in addition to the vibrator 20, the housing 21, and the elastic member 22. The holder 21*d* is provided on the housing 21 and is disposed above the vibrator 20. The sponge 25 is a flexible porous body disposed between the vibrator 20 and the holder 21*d*. The holder 21*d* holds the sponge 25. Regarding the installation structure of the third embodiment, FIG. 9 is a partial cross-sectional view like FIG. 5, and FIG. 10 is a top view seen from above in the Z direction. In the third embodiment, the structure of the vibrator 20 is the same as in the first and second embodiments. In the third embodiment, the structures of the housing 21 and the elastic member 22 are different from those in the first and second embodiments.

A step portion 21*e* is formed on the housing 21. The step portion 21*e* projects slightly upward in a range surrounding the opening 21*a*. The step portion 21*e* is formed with a pair of holders 21*d* facing each other in the X direction at a predetermined height in the Z direction. The pair of holders 21*d* forms a pair of side wall portions on a YZ plane adjacent to both ends in the X direction of the opening 21*a*. Further, the pair of holders 21*d* forms a pair of upper wall portions on an XY plane partially facing the vibrator 20 below by bending the uppermost portions of the side walls. Then, the sponge 25 is disposed in a space directly below the holder 21*d*. The sponge 25 is applied with a certain amount of pressing force in all directions as a porous body having elasticity, and is disposed slightly deformed. Therefore, the sponge 25 can stably hold the vibrator 20 directly below. Further, since the sponge 25 is lightweight, the mass added to the vibrator 20 can be reduced. In the present embodiment, the sponge is used as the member disposed between the vibrator 20 and the holder 21*d*. In this regard, the member is not limited to the sponge as long as it is lightweight and can stably hold the vibrator.

As illustrated in FIG. 9, the elastic member 22 has a flat plate shape within a range of the opening 21*a*. The both ends in the X direction of the elastic member 22 are bent upward, and are fitted in groove portions directly below the step portion 21*e* of the housing 21. In this state, the elastic member 22 is fixed to the housing 21. As the method of fixing the elastic member 22 to the housing 21, there can be employed a method of using adhesion or fusion, a method of using the pin as in the first and second embodiments of the combination of these methods, and further a method of fixing the elastic member 22 to the housing 21 by fitting a frame 26 corresponding to a shape of a circumference of the groove portion in the entire groove portion, and the like. The third embodiment is also similar to the first and second embodiments in that the first mechanical impedance obtained by combining the elastic member 22 and the sponge 25 is set smaller than twice the second mechanical impedance of the ear cartilage. However, the third embodiment has an overall structural difference from the first and second embodiments. Therefore, in the elastic member 22 of the third embodiment, the parameters such as area and thickness are required to be adjusted differently from those of the first and second embodiments. Note that, in the third embodiment, since the basic effect obtained by setting the first mechanical impedance smaller than twice the second mechanical impedance is the same as the first and second embodiments, the description will be omitted.

Fourth Embodiment

Figure 11:
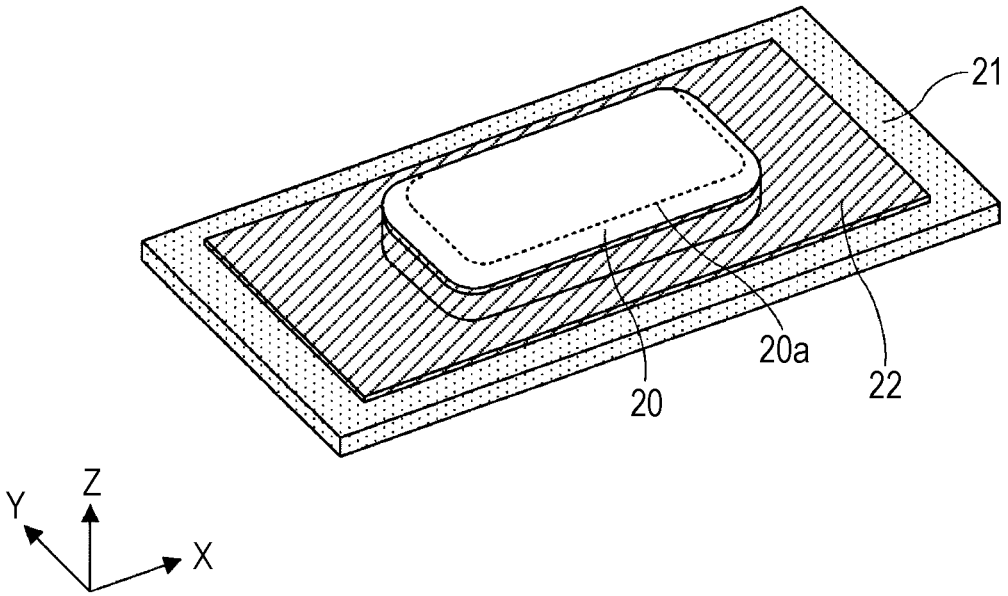
FIG. 11 is a perspective view of the installation structure of a fourth embodiment.

Hereinafter, a fourth embodiment of the present disclosure will be described with reference to FIGS. 11 and 12.

The installation structure according to the fourth embodiment includes the vibrator 20, the housing 21, and the elastic member 22, and other members are unnecessary. Therefore, the number of members can be reduced. The structure of the elastic member 22 is particularly characteristic in the fourth embodiment. Regarding the installation structure of the fourth embodiment, FIG. 11 is a perspective view like FIG. 4, and FIG. 12 is a partial cross-sectional view like FIG. 5. In the fourth embodiment, the structure of the vibrator 20 is the same as those of the first to third embodiments. The fourth embodiment is different from the other embodiments in that both an upper surface 20*a* and a lower surface 20*b* of the vibrator 20 are exposed.

An inner peripheral portion 22*f* is formed in the elastic member 22. In a plan view seen from the Z direction, a region where the vibrator 20 is disposed is opened in the inner peripheral portion 22*f*, and the inner peripheral portion 22*f* entirely covers the side surface of the vibrator 20. That is, as illustrated in FIG. 12, the elastic member 22 is formed to have a T-shaped cross-section. The elastic member 22 includes the above-described inner peripheral portion 22*f* that extends in an XZ plane and the YZ plane, and an outer peripheral portion 22*g* that extends in the XY plane. The vibrator 20 is stably held by the elastic member 22 in a state where four side surfaces of the vibrator 20 are in contact with the inner peripheral portion 22*f* of the elastic member 22. The outer peripheral portion 22*g* of the elastic member 22 is formed to have a size larger than that of the opening 21*a* in a center of the housing 21. An outer edge of the outer peripheral portion 22*g* is fixed to the upper surface of the housing 21. As a method of fixing the elastic member 22 to the housing 21, the method of using adhesion or fusion, the method of using the pin, or the combination of these methods can be employed as in the first to third embodiments.

The fourth embodiment is also similar to the first to third embodiments in that the first mechanical impedance of the elastic member 22 is set smaller than twice the second mechanical impedance of the ear cartilage. However, in the installation structure of the fourth embodiment, the lower surface 20*b* of the vibrator 20 directly contacts the skin near the ear cartilage. Therefore, it is preferable to adjust the first mechanical impedance in consideration of the influence. In the fourth embodiment, since the basic effect obtained by setting the first mechanical impedance smaller than twice the second mechanical impedance is the same as the first to third embodiments, the description will be omitted. Further, in order to form the elastic member 22 having a T-shaped cross-section, a mold or the like having a similar cross-section may be satisfactorily used.

Figure 12:
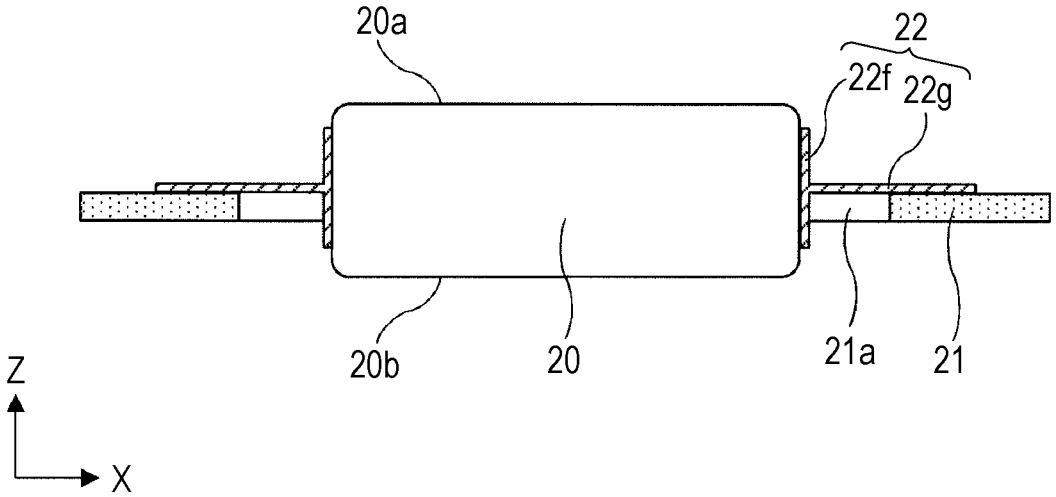
FIG. 12 is a partial cross-sectional view of the installation structure of the fourth embodiment.
Figure 13:
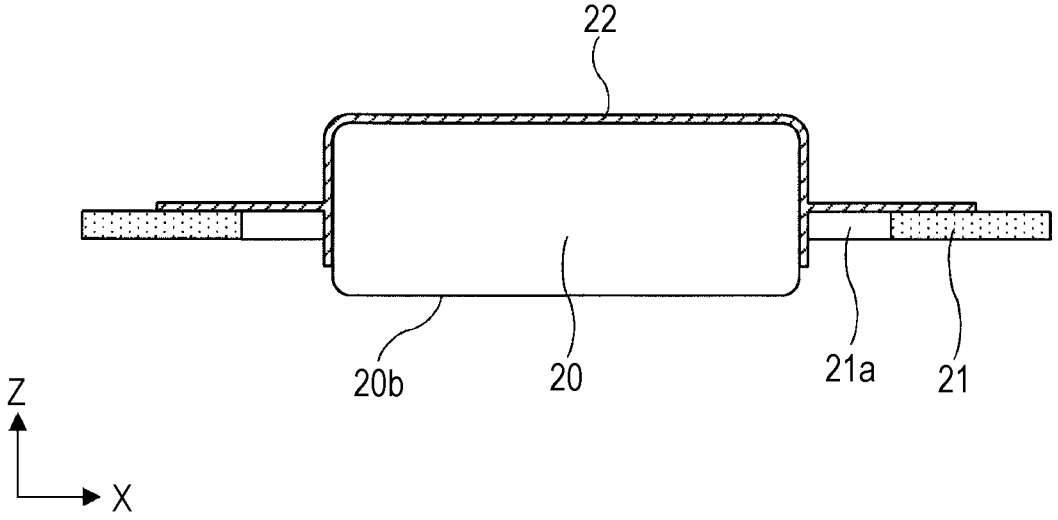
FIG. 13 is a partial cross-sectional view like FIG. 12 regarding a modification of the fourth embodiment.

Next, FIG. 13 illustrates a partial cross-sectional view like FIG. 12 regarding a modification of the installation structure of the fourth embodiment. In the present modification, the structure of the elastic member 22 in FIG. 12 is mainly changed. That is, as illustrated in FIG. 13, the elastic member 22 of the present modification has a structure in which the inner peripheral portion 22*f* illustrated in FIG. 12 extends upward and covers the entire upper surface 20*a* of the vibrator 20. By employing the structure of the modification of FIG. 13, an area of the vibrator 20 in contact with the elastic member 22 is increased as compared with FIG. 12. Therefore, the vibrator 20 can be held more stably.

Details of the technology of the present disclosure have been specifically described above based on the above-described embodiments. The installation structure of the vibrator 20 according to the present disclosure is not limited to the structures disclosed in the above-described embodiments, and various modifications can be made without departing from the spirit of the invention. Further, as for the material, shape, and fixing method of the elastic member 22, various forms can be widely employed as long as they have basic characteristics described in each of the above embodiments and can obtain the same effects. Furthermore, a site where the elastic member 22 or the vibrator 20 contacts is not limited to an outside of the pinna as illustrated in FIG. 3, but may be another site such as an inside of the pinna.

The installation structure of the vibrator according to the present embodiment may be the following first installation structure of the vibrator. The first installation structure of the vibrator is the installation structure for installing the vibrator in which the vibrator accommodating the electromechanical transducer that transduces the electric signal into mechanical vibration is installed on the listening device, wherein the elastic member made of an elastic material is disposed between the housing of the listening device and the vibrator, the vibrator is disposed at a position where the lower surface of the vibrator faces the ear cartilage in the state where the listening device is worn on the ear, and the first mechanical impedance of the elastic member between the vibrator and the housing is set smaller, at the frequency of 200 Hz to 1000 Hz, than twice the second mechanical impedance, with which the vibrator is loaded, of the ear cartilage.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An installation structure of a vibrator, comprising elastic members formed of an elastic material, the elastic members being arranged between a housing of a listening device, and the vibrator accommodating an electromechanical transducer for transducing an electric signal into mechanical vibration, wherein the vibrator is installed on the listening device such that a lower surface of the vibrator is disposed at a position facing an ear cartilage in a state where the listening device is worn on an ear, and a first mechanical impedance of the elastic members between the vibrator and the housing is set smaller, at a frequency of 200 Hz to 1000 Hz, than twice a second mechanical impedance, with which the vibrator is loaded, of the ear cartilage.

2. The installation structure of the vibrator according to claim 1, wherein the elastic members constitute a pair of elastic members including a second elastic member that is disposed on an upper surface facing the lower surface of the vibrator and applies a pressing force to the vibrator, and the pair of elastic members sandwiches and holds the vibrator.

3. The installation structure of the vibrator according to claim 1, further comprising:

a protrusion provided on the lower surface of the vibrator and projecting toward the ear cartilage; and a recess provided on the elastic member and conforming to a shape of the protrusion, wherein the vibrator is held by the elastic member with the protrusion being fitted in the recess.

4. The installation structure of the vibrator according to claim 3, wherein the protrusion is a columnar member connected to the vibrator, and the recess is formed such that its central axis is the same as a central axis of the columnar member and it has a diameter substantially the same as that of the columnar member.

5. The installation structure of the vibrator according to claim 1, further comprising:

a flexible porous body disposed on the upper surface facing the lower surface of the vibrator; and a holder provided in the housing and holding the porous body; wherein the first mechanical impedance is a combined mechanical impedance of the elastic member and the porous body.

6. The installation structure of the vibrator according to claim 1, further comprising an inner peripheral portion provided in the elastic member and covering a side surface of the vibrator, wherein the vibrator is held by the elastic member while contacting the inner peripheral portion.

* * * * *